US005166022A

United States Patent [19]

Suzuki et al.

[11] Patent Number: 5,166,022

[45] Date of Patent: Nov. 24, 1992

[54] ELECTROPHOTOGRAPHIC PHOTORECEPTOR

[75] Inventors: Shinichi Suzuki, Hino; Hirofumi Hayata, Fuchu; Osamu Sasaki, Hachioji, all of Japan

[73] Assignee: Konica Corporation, Tokyo, Japan

[21] Appl. No.: 613,060

[22] Filed: Nov. 15, 1990

[30] Foreign Application Priority Data

Nov. 16, 1989 [JP] Japan ..... 1-298282

[51] Int. Cl.[5] ..... G03G 5/047; G03G 5/09

[52] U.S. Cl. ..... 430/59; 430/83

[58] Field of Search ..... 430/59, 83

[56] References Cited

U.S. PATENT DOCUMENTS 3,533,786 10/1970 Looker ..... 430/83 X
4,245,021 1/1981 Kazami et al. ..... 430/59 X
5,024,912 6/1991 Neishi et al. ..... 430/59

FOREIGN PATENT DOCUMENTS 30852 2/1988 Japan ..... 430/59

*Primary Examiner*—Roland Martin
*Attorney, Agent, or Firm*—Finnegan, Henderson, Farabow, Garrett and Dunner

[57] ABSTRACT

An electrophotographic photoreceptor is disclosed. The photoreceptor comprises a conductive substrate and a light-sensitive layer containing a carrier-transfer material represented by the following Formula I:

wherein Ar is an alkyl group, an aralkyl group, an aryl group or a heterocyclic group; X is $—CH_2CH_2—$ group or —CH=CH— group: $R_1$, $R_2$ and $R_3$ are each a hydrogen atom, a halogen atom, an alkyl group or an alkoxy group.

The photoreceptor is excellent in electrifiability and sensitivity and capable of maintaining a stable performance.

5 Claims, 2 Drawing Sheets

ELECTROPHOTOGRAPHIC PHOTORECEPTOR

FIELD OF THE INVENTION

The present invention relates to an electrophotographic photoreceptor, more specifically to an electrophotographic photoreceptor having a light-sensitive layer containing a carrier-generation material and a carrier-transfer material.

BACKGROUND OF THE INVENTION

There have been widely known electrophotographic photoreceptors with a light-sensitive layer comprising an inorganic photoconductor such as selenium, zinc oxide, cadmium sulfide or silicon as a main component. But these materials are not entirely satisfactory in properties such as thermal resistance and durability, besides problems in manufacturing and handling On the contrary, a photoreceptor having a light-sensitive layer comprising an organic photoconductor has many advantages including easiness in manufacture, inexpensiveness, simplicity in handling, and better thermal stability as compared with a selenium photoreceptor. Poly-N-vinylcarbazole is best known as such an organic photoconductive compound, and there has been practically used a photoreceptor having a light-sensitive layer which mainly comprises of poly-N-vinylcarbazole and a charge-transfer complex formed from a Lewis acid such as 2,4,7-trinitro-9-fluorenone and polyvinylcarbazole.

Also, there is known a photoreceptor having a function-separated photoconductive layer of laminated or single-layered type, in which functions of carrier-generation and carrier-transfer are separately allotted to different materials. For example, there has come to be practically used a photoreceptor comprising a carrier-generation layer composed of a thin amorphous selenium layer and a carrier-transfer layer mainly made up from poly-N-vinylcarbazole.

However, poly-N-vinylcarbazole is less flexible, and its film is liable to crack and peel off, thereby a photoreceptor formed from this material is poor in durability. Addition of plasticizer to correct this defect tends to increase residual potential while an electrophotographic process is performed, and repetition of the process causes the residual potential to accumulate and accelerates the generation of fog which substantially impairs copied images.

Further, since low molecular weight organic photoconductive compounds cannot form a film in general, they are used in combination with an appropriate binder. While it is convenient that physical properties and light-sensitive characteristics of the film can be controlled to same extent by selecting a type and addition amount of a binder, the number of organic photoconductive compounds having a high compatibility with a binder is not many. Actually, only few binders can be used in forming a light-sensitive layer of an electrophotographic photoreceptor.

For example, 2,5-bis(p-diethylaminophenyl)-1,3,4-oxadiazole described in U.S. Pat. No. 3,189,447 is less compatible with polyester and polycarbonate both of which are commonly used as a component of light-sensitive layer of an electrophotographic photoreceptor. When a light-sensitive layer is formed by incorporating this material at a percentage necessary to impart electrophotographic properties, crystals of oxadiazole come to form at a temperature of 50° C. or above, deteriorating electrophotographic properties such as charge-holding power and sensitivity.

Diaryl alkane derivatives described in U.S. Pat. No. 3,820,989 have less problems with respect to compatibility with a binder. But their light stability is poor; therefore, when they are used in a light-sensitive layer of a photoreceptor for repetitive transfer type electrophotography in which a cycle of electrification and exposure is repeated, the sensitivity of said light-sensitive layer gradually deteriorates.

Different types of phenothiazine derivatives are described in U.S. Pat. No. 3,274,000 and Japanese Patent Examined Publication No. 36428/1972, respectively. But each of them has shortcomings of low sensitivity and low stability in a repetitive use.

Further, stilbene compounds described in Japanese Patent Publication Open to Public Inspection Nos. 65440/1983 and 190953/1983 have a good charge-holding power and sensitivity, but their poor durability is unfit for repetitive uses.

As mentioned above, there has not been found a carrier-transfer material exhibiting satisfactory properties when practically used in an electrophotographic photoreceptor.

SUMMARY OF THE INVENTION

An object of the present invention is to provide a high sensitive photoreceptor.

Another object of the present invention is to provide an electrophotographic photoreceptor of high sensitivity and low residual potential.

A further object of the present invention is to provide an electrophotographic photoreceptor of excellent durability which is less in fatigue and deterioration in repetitive uses and capable of maintaining stable characteristics for a long period of time.

The present invention relates to an electrophotographic photoreceptor comprising a conductive substrate and a light-sensitive layer containing a carrier-transfer material compounds represented by the following Formula I, and a carrier-generation material.

Formula I

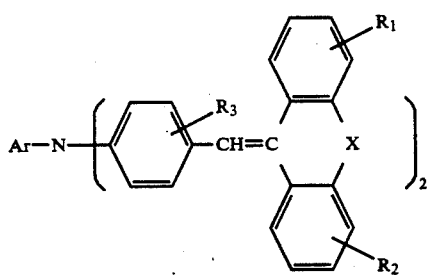

wherein Ar represents an alkyl group, an aralkyl group, an aryl group or a heterocycle, each of which may have a substituent; X represents $—CH_2CH_2—$ or $—CH=CH—$; and $R_1$, $R_2$, $R_3$ independently represent a hydrogen atom, a halogen atom, an alkyl group or an alkoxy group.

DETAILED DESCRIPTION OF THE INVENTION

Figure 1:
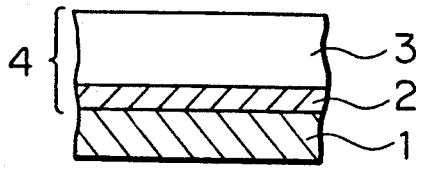
FIGS. 1 through 6 are cross-sectional views of examples of the photoreceptor of the invention.

In Formula I, the alkyl group represented by Ar includes methyl, ethyl, propyl and butyl groups; the aralkyl group includes benzyl and phenethyl groups; the aryl group includes phenyl and naphthyl groups; and the heterocycle includes furyl, thienyl, pyridyl and quinolyl groups. Each of these alkyl, aralkyl, aryl and heterocyclic groups may have a substituent. Examples of the substituent include an alkyl group such as methyl, ethyl, propyl or butyl group; an alkoxy group such as methoxy, ethoxy or propoxy group; a halogen atom such as fluorine, chlorine, bromine or iodine; a substituted amino group such as diphenyl amine or diethyl amine; and a cyano or nitro group. The alkyl group represented by each of $R_1$, $R_2$ and $R_3$ includes methyl, ethyl, propyl and butyl groups; the halogen atom includes fluorine, chlorine, bromine and iodine; and the alkoxy group includes methoxy, ethoxy and propoxy groups.

The compounds represented by Formula I may be prepared by reacting, in the presence of a basic catalyst at a temperature of 5° to 150° C., an aldehyde compound of the following Formula II with a phosphoric compound of the following Formula III, Formula II

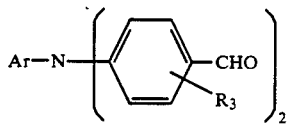

wherein Ar and $R_3$ are the same as defined for Formula I

Formula III

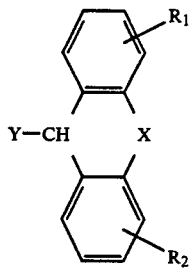

wherein Y is a triphenyl phosphonium group represented by

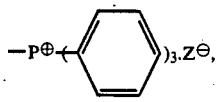

$Z^{\ominus}$ is a halogen ion, or a dialkyl phosphorous acid group represented by $-PO(OR_4)_2$ in which $R_4$ is a lower alkyl group, $R_1$ and $R_2$ are the same as defined with respect to Formula I.

The examples of the compound represented by Formula I are as follows:

Example compounds (1)

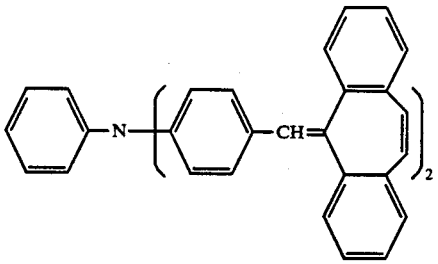

(2)

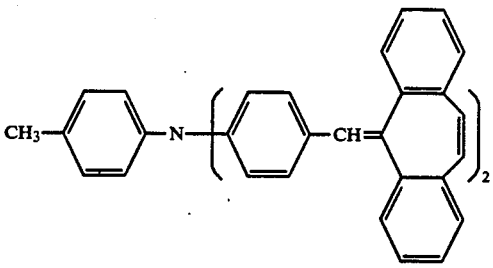

(3)

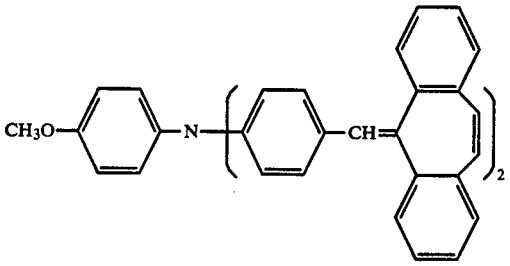

(4)

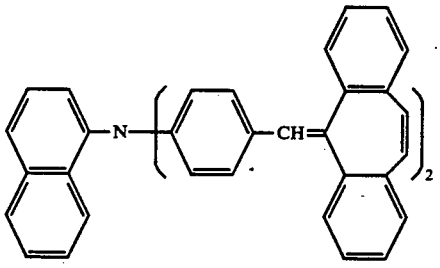

-continued
Example compounds
(5)
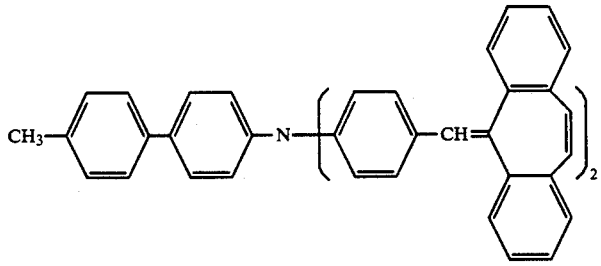
(6)
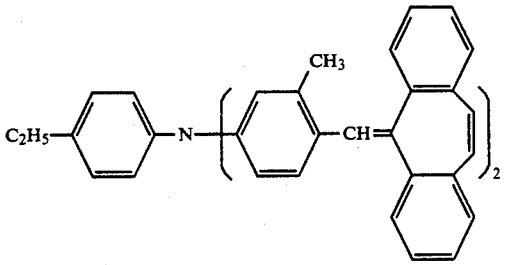
(7)
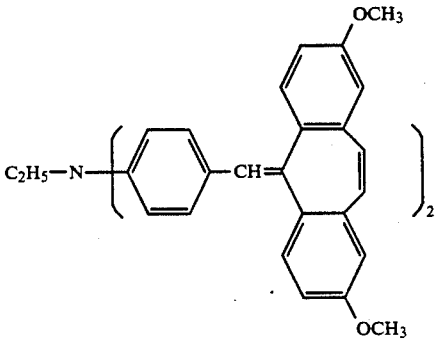
(8)
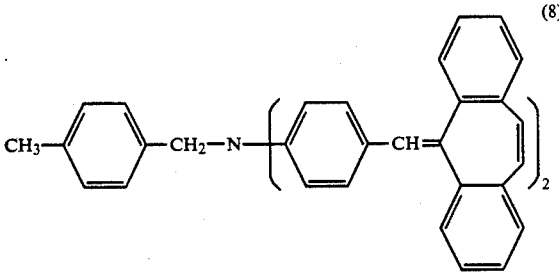
(9)
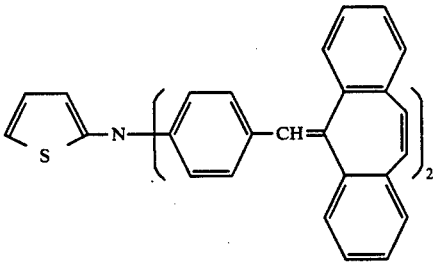
(10)
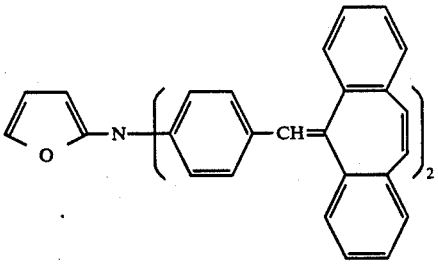
(11)
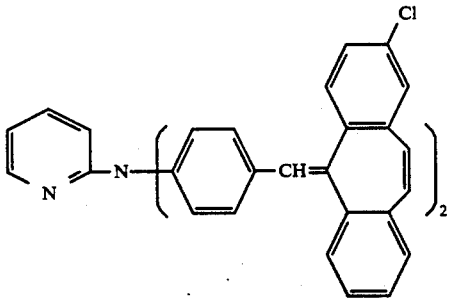
(12)
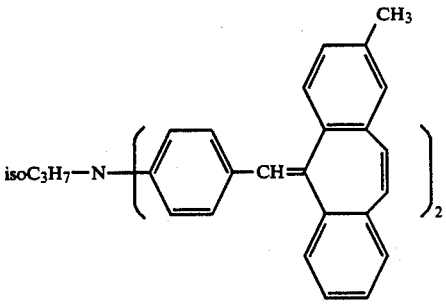
(13)
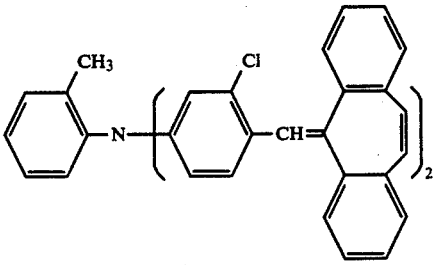

-continued
Example compounds
(14)
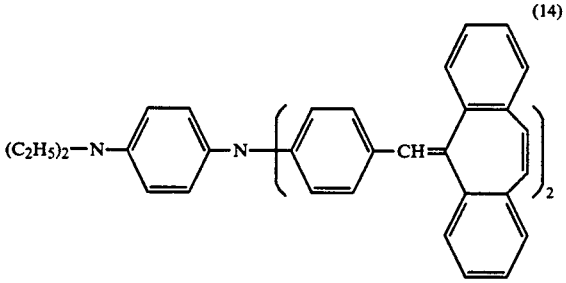
(15)
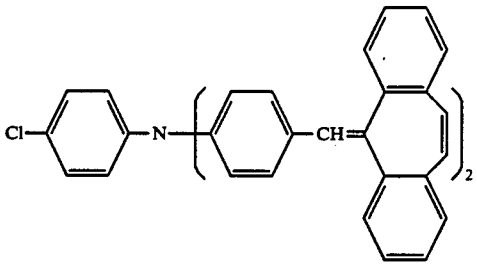
(16)
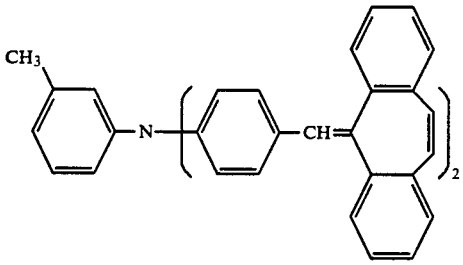
(17)
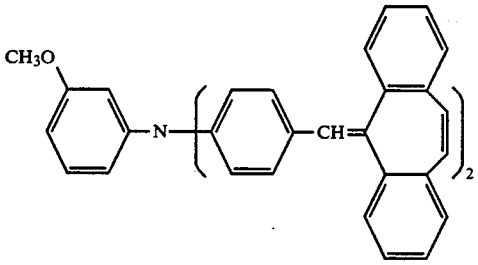
(18)
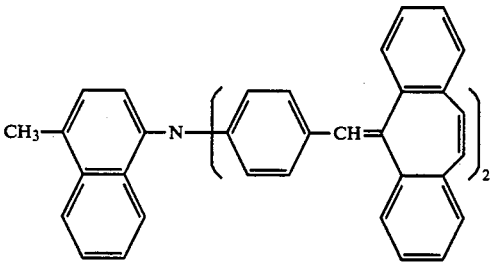
(19)
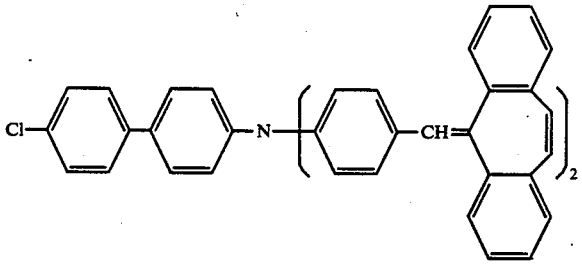
(20)
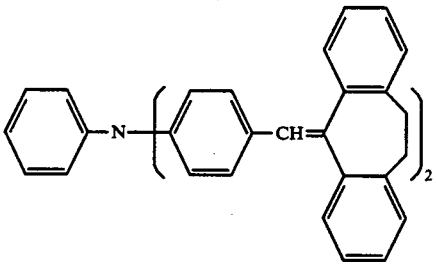
(21)
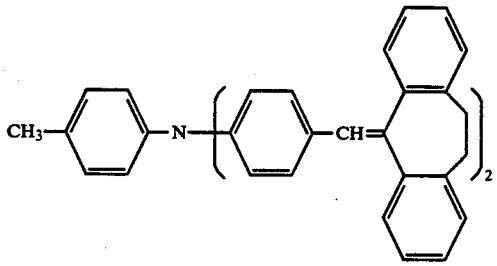

-continued
Example compounds
(22)
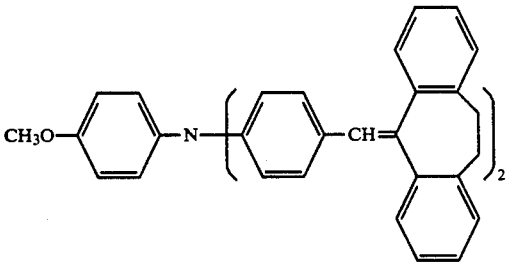
(23)
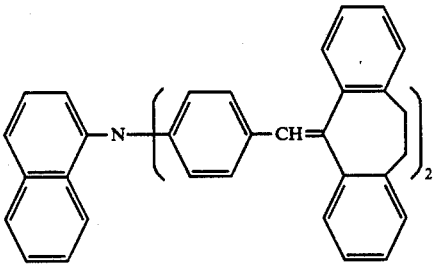
(24)
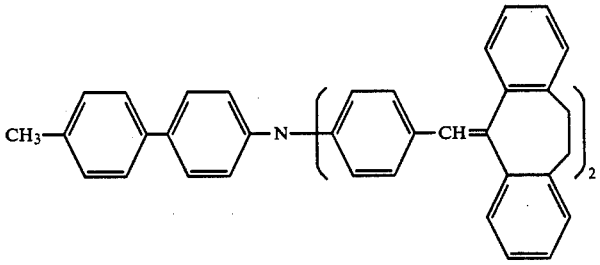
(25)
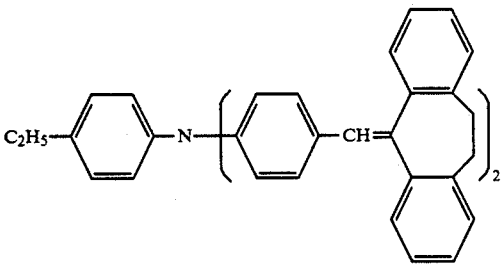
(26)
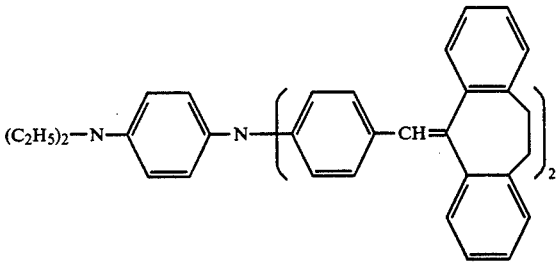
(27)
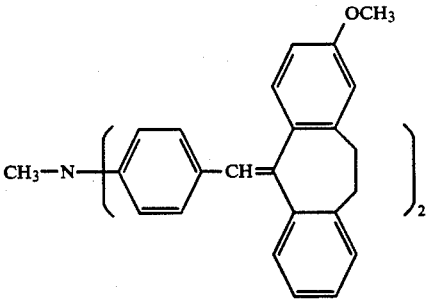
(28)
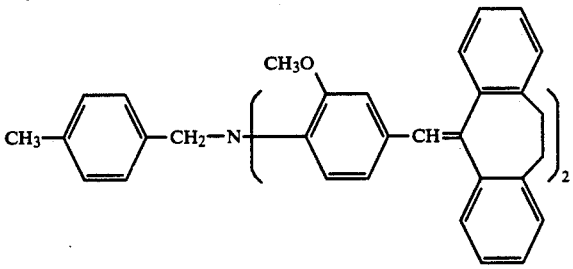

-continued
Example compounds
(29)
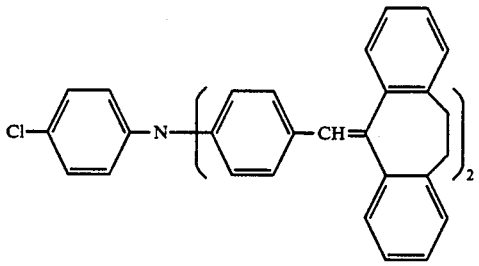
(30)
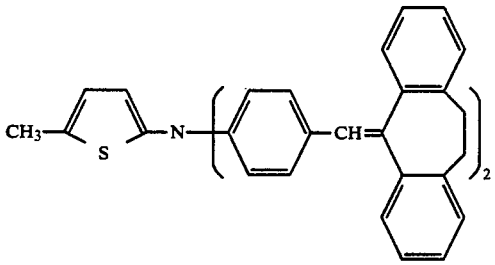
(31)
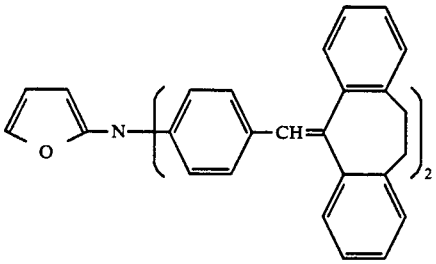
(32)
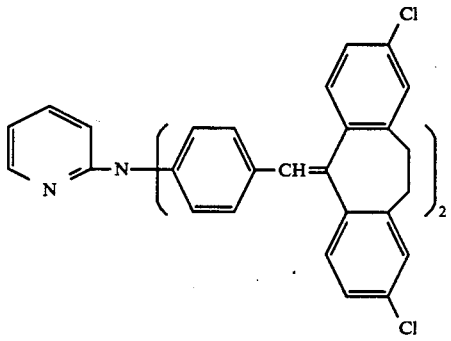
(33)
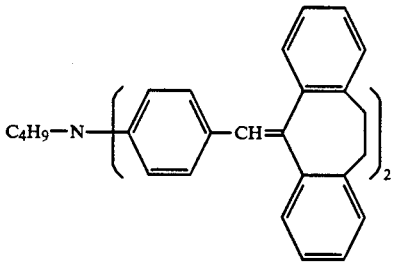
(34)
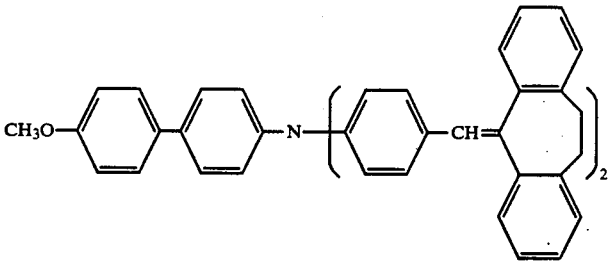
(35)
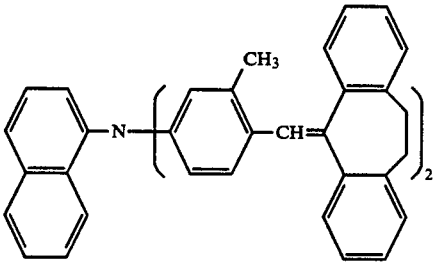
(36)
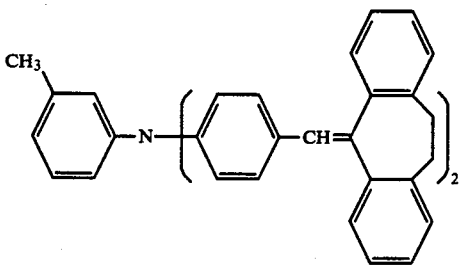

-continued

Example compounds (37)

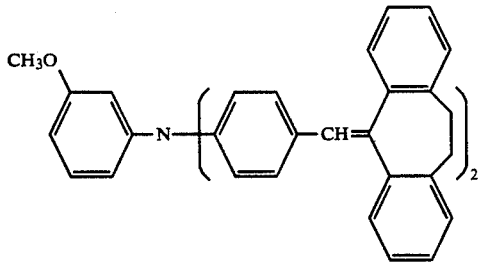

(38)

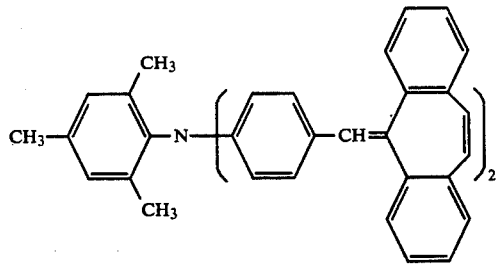

(39)

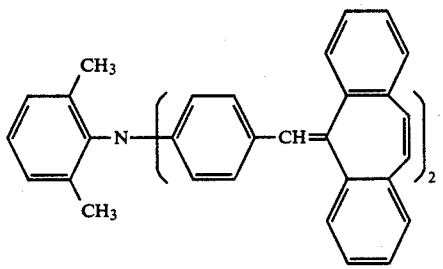

(40)

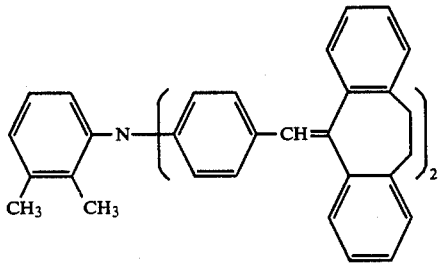

(41)

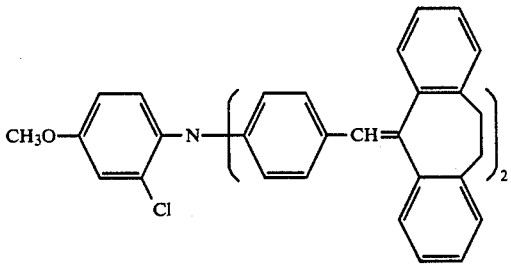

SYNTHESIS EXAMPLE 1

Synthesis of Exemplified Compound 1

There was dispersed and dissolved 3.4 g of potassium-t-butoxide in 50 ml of N,N-dimethylformamide at room temperature under a nitrogen atmosphere. 100 ml of N,N-dimethylformamide dissolving 3.0 g of 4,4'-diformyltriphenylamine and 7.2 g of diethyl 5H-dibenzo[a,d-]cycloheptenyl phosphonate was dropwise added thereto over a period of 10 minutes, and then the mixture was stirred for 3 hours at room temperature. Next, the reaction liquid was poured into 1 l of water and extracted with 200 ml of toluene. The organic layer was washed with water, then the solvent was removed. A silica gel column chromatography was performed using a toluene-hexane solvent. 4.0 g of the objective compound was thus prepared, yield was 61.3%.

By the FD mass spectrometry, the main peak of the objective compound, $(M^+)=649$ ($C_{50}H_{35}N_1$), was detected.

SYNTHESIS EXAMPLE 2

Synthesis of Exemplified Compound 9

There was dispersed and dissolved 3.4 g of potassium t-butoxide in 50 ml of N,N-dimethylformamide at room temperature and under a nitrogen atmosphere. One hundred mililiter of N,N-dimethylformamide dissolving 2.9 g of N,N-di-(4-formylphenyl)-2-furylamine and 7.2 g of diethyl 5H-dibenzo-[a,d]cyclopentenyl phosphonate was dropwise added thereto over a period of approximately 10 minutes, and then the mixture was stirred for 3 hours at room temperature. Next, the reaction liquid was poured into 1 l of water and extracted with 200 ml of toluene. The organic layer was washed with water, then the solvent was removed. Thus obtained residue was subjected to separation by silica gel column chromatography using toluene as solvent. The objective compound of 2.8 g was thus prepared with the yield of 43.8%.

By the FD mass-spectrometry, the main peak of the objective compound, $(M^+)=639$ ($C_{48}H_{33}N_1O_1$), was detected.

SYNTHESIS EXAMPLE 3

Synthesis of Exemplified Compound 20

There was dispersed and dissolved 3.4 g of potassium t-butoxide in 50 ml of N,N-dimethylformamide at room temperature and under a nitrogen atmosphere. One hundred mililiter of N,N-dimethylformamide dissolving 3.2 g of 4,4'-diformyl triphenylamine and 7.2 g of diethyl 5H-dibenzo-[a,d]cyclopentenyl phosphonate was dropwise added thereto over a period of approximately 10 minutes, and then the mixture was stirred for 3 hours at room temperature. Next, the reaction liquid was poured into 1 l of water and extracted with 200 ml of toluene. The organic layer was washed with water, then the solvent was removed. Thus obtained residue was subjected to separation by silica gel column chromatography using toluenehexane solvent. The objective compound of 3.9 g was thus prepared with the yield of 43.8%.

By the FD mass-spectrometry, the main peak of the objective compound, $(M^+)=653$ ($C_{50}H_{39}N_1$), was detected.

The above-mentioned compound represented by Formula I functions as a carrier-transfer material in a photoreceptor of the invention.

Various configurations of electrophotographic photoreceptor are known, and the electrophotographic photoreceptor of the invention may take any of such configurations.

Figure 2:
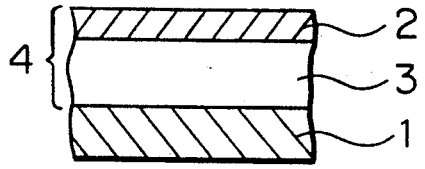

However, normal embodiments of the invention are of configurations shown by FIGS. 1 through 6. In FIGS. 1 and 2, there is provided on a conductive support 1 a light-sensitive layer 4 in which a carrier-generation layer 2 containing mainly of a carrier-generation material and a carrier-transfer layer 3 containing mainly a carrier-transfer material are laminated.

Figure 3:
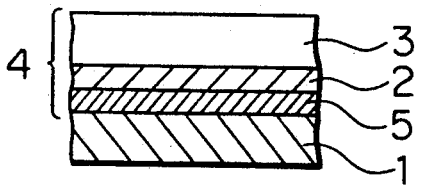
Figure 4:
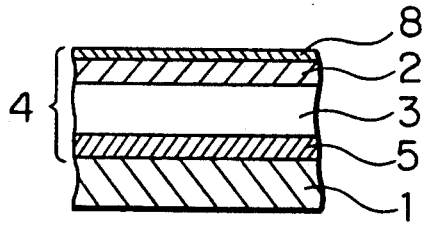
Figure 5:
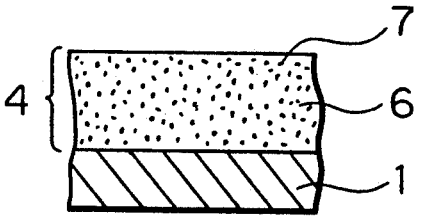
Figure 6:
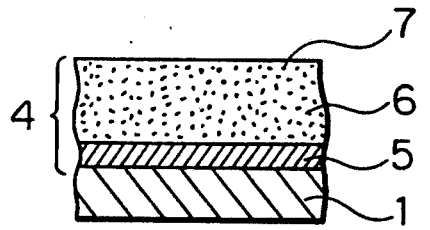

As shown in FIGS. 3 and 4, the light-sensitive layer 4 may be provided via an intermediate layer 5 formed on the conductive support. When the light-sensitive layer 4 has a double-layered configuration like this, a photoreceptor with the best electrophotographic property can be obtained. In the present invention, a light-sensitive layer 4 in which the preceding carrier-generation material 7 is dispersed in a layer 6 comprising mainly of the carrier-transfer material may also be provided directly or via an intermediate layer 5 on the conductive support 1 as shown in FIGS. 5 and 6. Further, a protective layer 8 may be provided as the outermost layer as shown in FIG. 4.

Examples of the carrier-generation material used in the carrier-generation layer of the invention include following substances:

(1) Azo type dyes such as monoazo dyes, disazo dyes and trisazo dyes
(2) Perylene type dyes such as perylenic acid anhydride and perylenic acid imide
(3) Indigo type dyes such as indigo and thioindigo
(4) Polycyclic quinones such as anthraquinone, pyrenequinone and flavanthrones
(5) Quinacridone type dyes
(6) Bisbenzimidazole type dyes
(7) Indanthrone type dyes
(8) Squarylium type dyes
(9) Cyanine type dyes
(10) Azulenium type dyes
(11) Triphenylmethane type dyes
(12) Amorphous silicon
(13) Phthalocyanine dyes such as metallic phthalocyanine and non-metallic phthalocyanine
(14) Selenium, selenium-tellurium and selenium-arsenic
(15) CdS and CdSe
(16) Pyrylium salt dyes and thiapyrylium salt dyes.

These substances may be used singly or in combination of two or more.

The substances in the present invention have no film-forming property by themselves; therefore, they are preferably compounded with various binders to form a light-sensitive layer.

In the invention, any binder may be used, but preferable ones are those polymers which are hydrophobic, high in dielectric constant and capable of forming an electrical insulating film. Examples of such polymers are as follows, but by no means limited to them.

(P-1 ) Polycarbonate
(P-2 ) Polyester
(P-3 ) Methacrylic resin
(P-4 ) Acrylic resin
(P-5 ) Polyvinyl chloride
(P-6 ) Polyvinylidene chloride
(P-7 ) Polystyrene
(P-8 ) Polyvinyl acetate
(P-9 ) Styrene-butadiene copolymer
(P-10) Vinylidene chloride-acrylonitrile copolymer
(P-11) Vinyl chloride-vinyl acetate copolymer
(P-12) Vinyl chloride-vinyl acetate-maleic anhydride copolymer
(P-13) Silicone resin
(P-14) Silicone-alkyd resin
(P-15) Phenol formaldehyde resin
(P-16) Styrene-alkyd resin
(P-17) Poly-N-vinylcarbazole
(P-18) Polyvinyl butyral
(P-19) Polyvinyl formal These binder resins may be used singly or in combination of two or more.

Among the above binder resins, a polycarbonate compound represented the following Formula IV or V is particularly preferable to form a carrier-transfer layer together with a compound of the invention represented by Formula I.

Formula IV

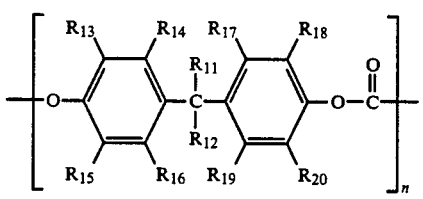

Formula V

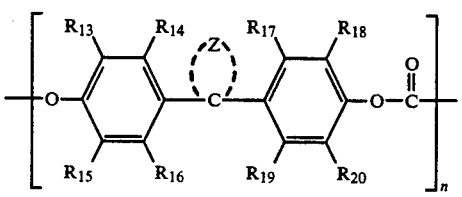

wherein $R_{11}$ and $R_{12}$ are each a hydrogen atom, a substituted or unsubstituted aliphatic group, or a substituted or unsubstituted hydrocarbon ring provided that at least one of groups represented by $R_{11}$ and $R_{12}$ has at least three carbon atoms; Z is a group of atoms necessary to form a substituted or unsubstituted carbon ring or a heterocyclic ring; $R_{13}$ to $R_{20}$ are each a hydrogen atom, a halogen atom, a substituted or unsubstituted aliphatic group, or a substituted or unsubstituted hydrocarbon ring; and n is an integer of 10 to 1000.

The polycarbonate Z-200 (Mitsubishi Gas Chemical Co.) described in example of the present specification is a resin represented by the following Formula VI:

Formula VI

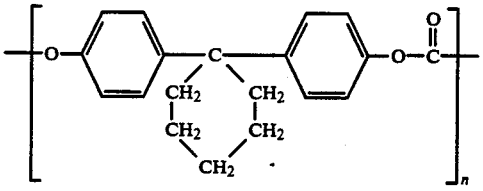

Examples of the solvent to form a carrier-generation layer and a carrier-transfer layer include N,N-dimethylformamide, acetone, methyl ethyl ketone, cyclohexanone, benzene, toluene, xylene, chloroform, 1,2-dichloroethane, 1,2-dichloropropane, 1,1,2-trichloroethane, 1,1,1,-trichloroethane, trichloroethylene, tetrachloroethane, dichloromethane, tetrahydrofuran, dioxane, methanol, ethanol, isopropanol, ethyl acetate, butyl acetate, dimethyl sulfoxide and methyl cellosolve. These solvents may be used in combination.

When a photoreceptor of the invention has a laminated configuration, the carrier-transfer layer preferably contains a binder in a ratio of 2 to 20 parts per 10 parts by weight of the carrier-transfer material. Thickness of the carrier-transfer layer is preferably 5 to 50 μm, more preferably 5 to 30 μm. Thickness of the carrier-generation layer is preferably 0.01 to 10 μm, more preferably 0.1 to 5 μm.

The carrier-generation layer may contain a carrier-transfer material of the invention. In this case, the ratio of the carrier-transfer material is preferably 1 to 50 parts per 10 parts by weight of the carrier-generation material.

Examples of the conductive support used in an electrophotographic photoreceptor of the invention include a plate of metal or alloy, metal drum, and plastic film and paper which are imparted conductivity by means of coating, vapour deposition or lamination of a thin layer of conductive compound such as a conductive polymer or indium oxide, or metal such as aluminum, palladium or gold, or an alloy thereof.

Binders used in an intermediate layer or a protective layer may be the same as those used in the carrier-generation layer and the carrier-transfer layer. Examples of other binders for the intermediate layer or the protective layer include polyamide resin; nylon resin; ethylene type resins such as ethylene-vinyl acetate copolymer, ethylene-vinyl acetate-maleic anhydride copolymer, ethylene-vinyl acetate-methacrylic acid copolymer; polyvinyl alcohol; and cellulose derivatives.

In a light-sensitive layer of the invention, an organic amine may be incorporated for the purpose of improving a carrier-generation function of the carrier-generation material. Of such organic amines, addition of a secondary amine is particularly preferred.

In the light-sensitive layer, deterioration inhibitors such as an oxidation inhibitor and a light-stabilizer may be added for the purposes of improving shelf life, durability and environmental dependency. Examples of such deterioration inhibitors include chromanol derivatives such as tocopherols and their etherified or esterified compounds, polyarylalkane compounds, hydroquinone derivatives and their mono- or dietherified compounds, benzophenone derivatives, benzotriazole derivatives, thioether compounds, phosphonates, phosphites, phenylenediamine derivatives, phenol compounds, hindered phenol compounds, straight chain amine compounds, cyclic amine compounds, and hindered amine compounds. Among them, particularly preferred ones are hindered phenol compounds such as "Irganox 1010" and "Irganox 565" (made by Ciba-Geigy Co.), "Sumilizer BHT" and "Sumilizer MDP" (made by Sumitomo Chemical Co.), and hindered amine compounds such as "Sanol LS-2626" and "Sanol LS-622LD" (made by Sankyo Co.).

In the carrier generation layer of the invention, one or more types of electron accepting substances may be added to enhance sensitivity and reduce residual potential and fatigue in the course of repetitive uses.

Examples of such electron accepting material include succinic anhydride, maleic anhydride, dibromomaleic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoqinodimethane, o-dinitrobenzene, m-dinitrobenzene, 1,3,5-trinitrobenzene, p-nitrobenzonitrile, picryl chloride, quinone chlorimide, chloranil, bromanil, dichlorodicyano-p-benzoquinone, anthraquinone, dinitroanthraquinone, 2,7-dinitrofluorenone, 2,4,7-trinitrofluorenone, 2,4,5,7-tetranitrofluorenone, 9-fluorenylidene-malonodinitrile, polynitro-9-fluorenylidene-malonodinitrile, picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid, and other compounds having a large electron affinity.

An addition amount of the electron accepting material is normally 0.01 to 200 parts by weight of the carrier-generation material, preferably 0.1 to 100 parts.

The electron accepting material may also be added to the carrier-transfer layer. The amount of addition is normally 0.01 to 100 parts by weight of the carrier-transfer material, preferably 0.1 to 50 parts.

Further, the photoreceptor of the invention may contain an ultraviolet absorbent to protect the light-sensitive layer, if necessary. A dye for correcting color sensitivity may also be contained.

The electrophotographic photoreceptor of the invention has the constitution described above, and as the following examples will explain, it is excellent in properties of electrification, sensitivity and image formation, and particularly advantageous in less deterioration due to fatigue in repetitive uses and in excellent durability.

Besides the electrophotographic copying machine, the electrophotographic photoreceptor of the invention can be widely used in areas such as photoreceptors whose light sources are a laser, cathode-ray tube or light emitting diode.

EXAMPLES

Example 1

On an aluminum vapour-deposited conductive polyester film support was provided a 0.08 μm thick intermediate layer comprised of a vinyl chloride-vinyl acetate-maleic anhydride copolymer "Eslec MF-10" (made by Sekisui Chemical Co.), and a coating solution prepared by dispersing 1 g of dibromoanthanthrone "Monolite Red 2Y" (C.I. No. 59300, made by I.C.I.) in 30 ml of 1,2-dichloroethane with a ball mill and then dissolving therein 1.5 g of polycarbonate "Panlite L-1250" (made by Teijin Chemical Co.) was coated on the intermediate layer to a dry film thickness of 2 μm so that a carrier-generation layer was formed.

Subsequently, a solution prepared by dissolving, in 80 ml of 1,2-dichloroethane, 7 g of the example compound 1, 10 g of polycarbonate "Z-200" (made by Mitsubishi Gas Chemical Co.) and a deterioration inhibitor "Irganox 1010" in an amount of 2 wt % of the carrier-transfer material was coated thereon so as to give a dry film thickness of 20 μm. A carrier-transfer layer was thus formed, thereby a photoreceptor of the invention was prepared.

The photoreceptor prepared as above was evaluated for the following characteristics with an electrostatic electrification tester model EPA-8100 made by Kawaguchi Electric Co. The photoreceptor was electrified for 5 seconds at an electrification voltage of 6 KV and allowed to stand for 5 seconds. Then, it was exposed to halogen lamp light at an illumination of 2 lux on its surface to determine the initial surface potential ($V_A$) and the exposure amount necessary for decreasing the surface potential value to half ($E_{\frac{1}{2}}$).

The measurement was repeated further 1000 times in the same manner as the above. The results are shown in Table 1.

TABLE 1

| | Initial | | After repeating 1000 times | |
|---|---|---|---|---|
| | (V)—$V_A$ | (lux · sec) $E_{\frac{1}{2}}$ | (V)—$V_A$ | (lux · sec) $E_{\frac{1}{2}}$ |
| Example 1 | 1540 | 1.7 | 1510 | 1.8 |

Examples 2 through 7

Photoreceptors were prepared and evaluated in the same manner as in Example 1, except that the example compounds shown in Table 2 were used in place of the example compound 1.

TABLE 2

| | | Initial | | After repeating 1000 times | |
|---|---|---|---|---|---|
| Example | Example compound | (V) —$V_A$ | (lux · sec) $E_{\frac{1}{2}}$ | (V) —$V_A$ | (lux · sec) $E_{\frac{1}{2}}$ |
| 2 | 3 | 1480 | 1.6 | 1470 | 1.7 |
| 3 | 5 | 1510 | 1.8 | 1480 | 1.9 |
| 4 | 10 | 1430 | 1.7 | 1400 | 1.8 |
| 5 | 22 | 1320 | 2.1 | 1310 | 2.3 |
| 6 | 27 | 1370 | 2.2 | 1340 | 2.5 |
| 7 | 38 | 1420 | 1.8 | 1390 | 1.9 |

Comparison 1

A comparative photoreceptor was prepared in the same manner as in Example 1, except that the following compound was used as a carrier-transfer material.

(33)

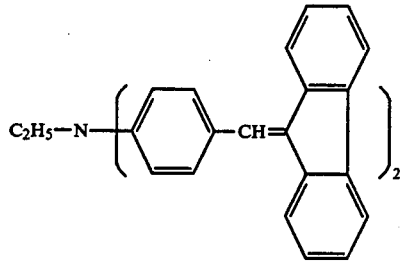

This comparative photoreceptor was evaluated in the same way as in Example 1, and the results obtained are shown in Table 3.

TABLE 3

| | Initial | | After repeating 1000 times | |
|---|---|---|---|---|
| | (V)—$V_A$ | (lux · sec) $E_{\frac{1}{2}}$ | (V)—$V_A$ | (lux · sec) $E_{\frac{1}{2}}$ |
| Comparison 1 | 1230 | 3.0 | 1120 | 3.8 |

Example 8

A 0.1 μm thick intermediate layer comprised of polyamide resin "A-70" (made by Toray Ind.) was formed on an aluminum vapour-deposited polyester film support.

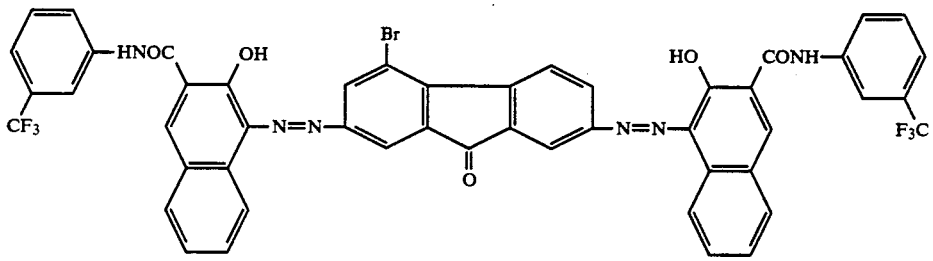

A coating dispersion was prepared by mixing 2 g of a bisazo pigment having the above structure and 2 g of polycarbonate resin "Panlite L-1250" in 100 ml of 1,2-dichloroethane and dispersing the mixture for 8 hours with a sand grinder. Then, the dispersion was coated on the intermediate layer so as to give a dry film thickness of 0.2 μm.

Subsequently, a photoreceptor was prepared using the example compound 2 as a carrier-transfer material and adding 2% of the deterioration inhibitor "Irganox 1010" to the carrier-transfer material. Then, a photoreceptor was prepared and evaluated in the same manner as in Example 1. The results are summarized in Table 4.

TABLE 4

| | Initial | | After repeating 1000 times | |
|---|---|---|---|---|
| | (V)—$V_A$ | (lux · sec) $E_{\frac{1}{2}}$ | (V)—$V_A$ | (lux · sec) $E_{\frac{1}{2}}$ |
| Example 8 | 1230 | 0.7 | 1220 | 0.8 |

Examples 9 through 14

A photoreceptor was prepared and evaluated in the same manner as in Example 8, except that the example compounds shown in Table 5 were used in place of the example compound 2.

TABLE 5

| | | Initial | | After repeating 1000 times | |
|---|---|---|---|---|---|
| Example | Example compound | (V) —$V_A$ | (lux · sec) $E_{\frac{1}{2}}$ | (V) —$V_A$ | (lux · sec) $E_{\frac{1}{2}}$ |
| 9 | 4 | 1340 | 0.8 | 1320 | 0.9 |
| 10 | 9 | 1270 | 0.9 | 1250 | 1.1 |
| 11 | 15 | 1320 | 0.8 | 1300 | 0.9 |
| 12 | 20 | 1250 | 1.2 | 1210 | 1.3 |
| 13 | 35 | 1280 | 1.3 | 1230 | 1.4 |
| 14 | 40 | 1310 | 1.2 | 1280 | 1.3 |

Comparison 2

A comparative photoreceptor was prepared in the same manner as in Example 8, except that the following compound was used as a carrier-transfer substance.

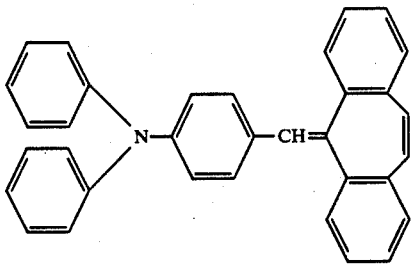

This photoreceptor was subjected to evaluation in the same way as in Example 1. The results are shown in Table 6.

TABLE 6

| | Initial | | After repeating 1000 times | |
|---|---|---|---|---|
| | (V)—$V_A$ | (lux · sec) $E_{\frac{1}{2}}$ | (V)—$V_A$ | (lux · sec) $E_{\frac{1}{2}}$ |
| Comparison 2 | 1460 | 1.8 | 1390 | 2.2 |

Example 15

A 0.2 μm thick intermediate layer comprised of polyamide resin "CM8000" (made by Toray Ind.) was formed on a polyester film support imparted conductivity by aluminum vapour deposition.

Figure 7:
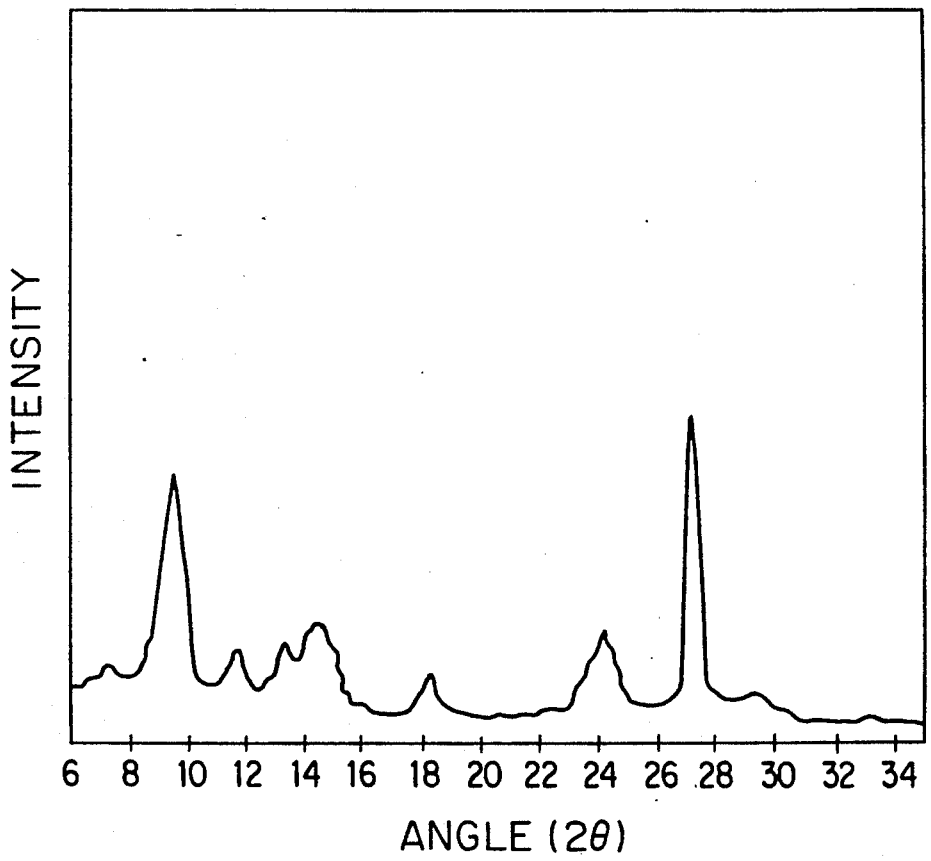
FIG. 7 is an X-ray diffraction pattern of titanylphthalocyanine used in the examples, when a Cu-K $\alpha$ ray was used as a radiation source.

There were dispersed 2 g of titanylphthalocyanine having an X-ray diffraction spectrum shown in FIG. 7 and 20 g of silicone resin "KR-5240, 15% xylene-butanol solution" (made by The Shin-Etsu Chemical Co.) in 100 ml of isopropanol with a sand mill, then the dispersion was coated on the intermediate layer to give a dry film thickness of 0.2 μm. Subsequently, a solution containing 7 g of the example compound 3 as a carrier-transfer material, 10 g of polycarbonate "Z-200" and 80 ml of 1,2-dichloroethane was coated thereon to a dry film thickness of 20 μm to form a carrier-transfer layer.

The photoreceptor was subjected to the same evaluation as in Example 1. The results are shown in Table 7.

TABLE 7

| | Initial | | After repeating 1000 times | |
|---|---|---|---|---|
| | (V)—$V_A$ | (lux · sec) $E_{\frac{1}{2}}$ | (V)—$V_A$ | (lux · sec) $E_{\frac{1}{2}}$ |
| Example 15 | 1230 | 0.3 | 1200 | 0.4 |

Example 16

A 0.2 μm thick intermediate layer comprising ethylene-vinyl acetate-methacrylic acid copolymer "Elvax 4260" (made by Mitsui Du Pont Chemical Co.) was formed on an aluminum drum.

A solution comprising 1 g of the example compound 26 as a carrier-transfer material, 1.5 g of polyester resin "VYLON 200" (made by Toyobo Co.) and 10 ml of 1,2-dichloroethane was coated on the intermediate layer so as to form a carrier-transfer layer with a dry film thickness of 15 μm. Further, as a carrier-generation material, 1 g of titanylphthalocyanine having an X-ray diffraction spectrum shown in FIG. 7, and as a binder, 3 g of polycarbonate "L-1250" (made by Teijin Chemical Co.) were dispersed in a dispersion medium consisting of 15 ml of monochlorobenzene and 35 ml of 1,2-dichloroethane with a ball mill. Then, the example compound 26 was added thereto as a carrier-transfer material in an amount of 75 wt % of the binder resin. The resultant dispersion was spray-coated on the above carrier-transfer layer to form a carrier-generation layer having a dry film thickness of 2 μm.

The photoreceptor prepared as above was evaluated in the same manner as in Example 1 except that a positive polarity was used as the electrification polarity.

$$VA = 1180(V)$$

$$E_{\frac{1}{2}} = 0.6(lux.sec)$$

Example 17

A 0.1 μm thick intermediate layer comprising vinyl chloride-vinyl acetate-maleic anhydride copolymer "Eslec MF-10" (made by Sekisui Chemical Co.) was formed on an aluminum drum. As a carrier-generation material, 1 g of dibromoanthanthrone "Monolite Red 2Y" was pulverized with a ball mill. Then, 3 g of polycarbonate resin "Panlite L-1250", 15 ml of monochlorobenzene and 35 ml of 1,2-dichloroethane were added thereto and the mixture was dispersed. After adding 2 g of the example compound 15 thereto as a carrier-transfer material, the resultant dispersion was sprayed on the above intermediate layer and dried, so that a 20 μm thick light-sensitive layer was formed.

The photoreceptor prepared as above was evaluated in the same manner as in Example 1 except that a positive polarity was used as the electrification polarity.

$$VA = 1230(V)$$

$$E_{\frac{1}{2}} = 2.5(lux.sec)$$

What is claimed is:

1. An electrophotographic photoreceptor comprising a conductive substrate and a light-sensitive layer wherein said light-sensitive layer comprises a carrier-transfer layer containing said carrier-transfer material and a carrier-generation layer containing a carrier-generation material, or wherein said light-sensitive layer comprises a carrier generation material dispersed in a carrier transfer material, and said carrier-transfer material is represented by the following Formula I

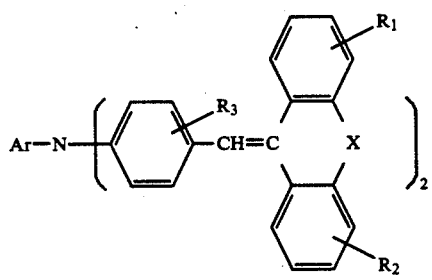

(I)

wherein Ar is an alkyl group, an aralkyl group, an aryl group or a heterocyclic group, each of which may have a substituent; X is a —$CH_2CH_2$— group or a —CH=CH— group; and $R_1$, $R_2$, and $R_3$ are each a hydrogen atom, a halogen atom, an alkyl group or an alkoxy group.

2. The photoreceptor of claim 1, wherein said carrier-transfer layer comprises said carrier-transfer material and a binder.

3. The photoreceptor of claim 2, wherein said carrier-transfer layer contains a binder in a ratio of 2 to 20 parts per 10 parts by weight of said carrier-transfer material.

4. The photoreceptor of claim 2, wherein said carrier-transfer layer has thickness of from 5 μm to 50 μm.

5. The photoreceptor of claim 4, wherein said carrier-transfer layer has thickness of from 5 μm to 30 μm.

* * * * *